United States Patent [19]

Hughes

[11] 4,192,465

[45] Mar. 11, 1980

[54] VORTEX GENERATING DEVICE WITH EXTERNAL FLOW INTERRUPTING BODY

[76] Inventor: Nathaniel Hughes, 1934 Sonora Rd., Palm Springs, Calif. 92262

[21] Appl. No.: 886,288

[22] Filed: Mar. 13, 1978

Related U.S. Application Data

[63] Continuation-in-part of Ser. No. 785,838, Apr. 8, 1977, Pat. No. 4,109,862.

[51] Int. Cl.[2] ..... B05B 17/06; F15C 1/16

[52] U.S. Cl. ..... 239/405; 137/808; 239/467; 239/500; 239/524; 239/590.3; 261/DIG. 48; 261/DIG. 78

[58] Field of Search ..... 239/102, 403, 405, 431, 239/434, 463, 466, 467, 472, 474, 475, 487, 488, 499, 509, 518, 524, 589, 590–590.5, DIG. 20; 137/808, 811; 261/DIG. 48, DIG. 78

[56] References Cited

U.S. PATENT DOCUMENTS

| | | | |
|---|---|---|---|
| 3,226,029 | 12/1965 | Goodman et al. | 239/102 X |
| 3,747,851 | 7/1973 | Conrad | 239/403 X |
| 3,806,029 | 4/1974 | Hughes | 239/102 X |
| 4,109,862 | 8/1978 | Hughes | 239/102 |

FOREIGN PATENT DOCUMENTS

| | | | |
|---|---|---|---|
| 1104208 | 11/1955 | France | 239/403 |

*Primary Examiner*—John J. Love
*Assistant Examiner*—Andres Kashnikow
*Attorney, Agent, or Firm*—Christie, Parker & Hale

[57] ABSTRACT

A vortex is formed in fluid flowing through a flow passage from the inlet of the passage to its outlet. A bluff body is disposed at the outlet external to the passage to interrupt vortically flowing fluid. In one embodiment, the bluff body, which could comprise one or more frustums or discs, has a flat surface facing the outlet. In another embodiment, the body comprises a sphere. In a third embodiment, the body comprises a frustum and a sphere adjacent to each other on the flow axis.

63 Claims, 7 Drawing Figures

VORTEX GENERATING DEVICE WITH EXTERNAL FLOW INTERRUPTING BODY

CROSS REFERENCE TO RELATED APPLICATIONS

This application is a continuation-in-part of application Ser. No. 785,838, filed Apr. 8, 1977, now U.S. Pat. No. 4,109,862.

BACKGROUND OF THE INVENTION

This invention relates to fluid vortex generation and, more particularly, to an improved vortex generating device useful as an atomizer and/or a sonic energy transducer.

In one class of sonic energy transducer, sonic waves are generated by accelerating a gas to supersonic velocity in a nozzle. To achieve supersonic flow it has been necessary in the past to establish a large pressure drop from the inlet to the outlet of the nozzle. In order to produce sufficiently high energy levels for effective atomization and other purposes, prior art sonic energy transducers have used a resonator beyond the outlet of the supersonic nozzle, as disclosed in my U.S. Pat. No. 3,230,924, which issued Jan. 25, 1966, or a sphere in the diverging section of the supersonic nozzle, as disclosed in my U.S. Pat. No. 3,806,029, which issued Apr. 23, 1974.

In my application Ser. No. 886,289, filed on even date herewith, entitled STABLE VORTEX GENERATING DEVICE, a stable efficient vortex is generated in a flow passage having a restriction connected between a fluid inlet and outlet. A bluff body is disposed in the fluid passage between the inlet and the restriction. The inlet is transverse to the axis of the flow passage, and the bluff body is mounted on a rod extending through the flow passage.

SUMMARY OF THE INVENTION

According to the invention, plural bluff bodies are disposed at the outlet of a flow passage that forms a vortex in fluid flowing therethrough. The bluff bodies lie external to the passage to form therebetween an annular channel and present a flat surface facing toward the outlet, theeby interrupting and enhancing the energization of the fluid flowing vortically through the passage by forming a standing shock wave that serves as a reflector of the sonic energy in the fluid emanating from the outlet of the passage.

In one embodiment, the bluff bodies comprises one or more pairs of frustums arranged apex-to-apex. A subatmospheric pressure is produced in the annulus formed by the frustums, which give rise to shock waves and thus enhances the energization of the fluid. Preferably, the distance between the bases of the frustums is approximately equal to the base diameter of the frustums. Thin discs could be substituted for the frustums as the bluff body with similar results.

In another embodiment, the bluff body comprises a frustum having its base facing toward the outlet of the passage and a sphere abutting the apex of the frustum. This form of bluff body produces some of the effects of both of the previously described embodiments.

BRIEF DESCRIPTION OF THE DRAWINGS

The feature of specific embodiments of the best mode contemplated of carrying out the invention are illustrated in the drawings, in which.

DETAILED DESCRIPTION OF THE SPECIFIC EMBODIMENTS

The disclosures of my application Ser. No. 785,838 and my application Ser. No. 886,289, filed on even date herewith, entitled STABLE VORTEX GENERATING DEVICE, are incorporated fully herein by reference.

Figure 1:
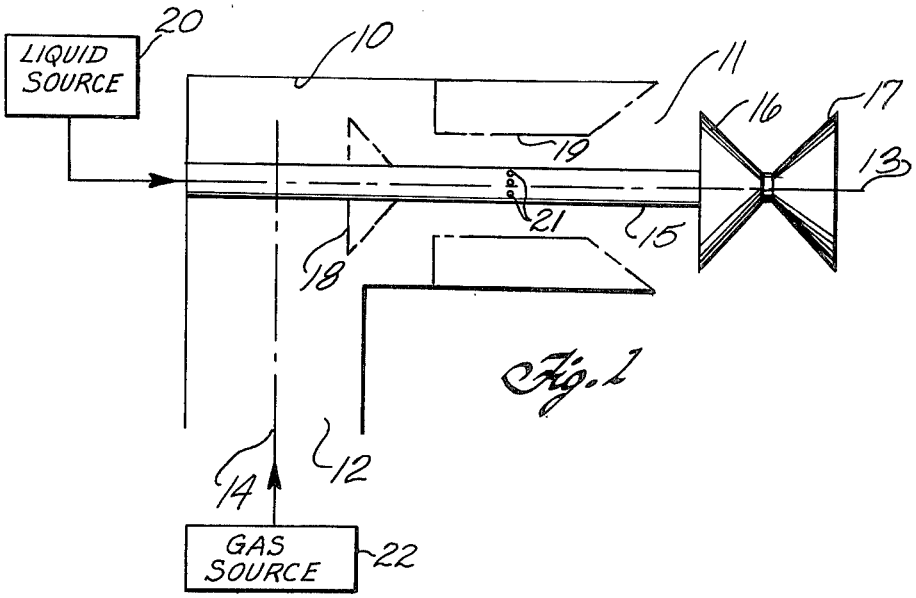
FIG. 1 is a schematic diagram of a vortex generating device with an external bluff body incorporating the principles of the invention.

In FIG. 1, a cylindrical flow passage 10 has an outlet 11 and a transverse cylindrical inlet 12. Passage 10 has a cylindrical axis 13 that serves as a flow axis. Inlet 12 has a cylindrical axis 14 that intersects axis 13, preferably at a right angle. A rod 15 extends all the way through passage 10 to a point beyond outlet 11, i.e., external to passage 10, in alignment with axis 13. Conical frustums 16 and 17 are mounted in alignment with axis 13 on the end of rod 15 external to passage 10, where they are arranged apex-to-apex to form therebetween an annular channel. The base of frustums 16 and 17 have flat circular surfaces. The base of frustum 16 faces toward outlet 11, and the base of frustum 17 faces away from outlet 11.

A vortex is formed in the fluid flowing through passage 10 by a frustum 18 and a nozzle 19 in the manner described in my referenced application Ser. No. 886,289, filed on even date herewith and called hereafter "my referenced application." Frustum 18 and nozzle 19 are shown in phantom to indicate that other types of elements for forming a vortex in passage 10 could be employed in practicing the invention, including the other embodiments in my referenced applications, or internal vortex forming elements could be eliminated altogether in some embodiments. Except for the substitution of frustums 16 and 17 for a sphere, FIG. 1 is the same as FIG. 1 of my referenced application. If desired, rod 15 could be hollow and carry a liquid under pressure from a liquid source 20 to be atomized to nozzle 19 or other desired point along axis 13 by means of a plurality of liquid feed holes 21 in the manner described in the referenced application.

A source of gas 22 is supplied to inlet 12. The gas flows from inlet 12 through passage 10 to outlet 11, and a vortex is formed therein by frustum 18 and nozzle 19. Frustums 16 and 17 serve as a bluff body to interrupt at outlet 11 fluid flowing vortically through passage 10 and to form a standing shock wave that reflects the sonic waves emanating from outlet 11. A subatmospheric pressure, i.e., a pressure below the ambient pressure beyond outlet 11, is formed in the annular space between frustums 16 and 17. With a gas source pressure of the order of 10 psig, a subatmospheric pressure of the order of 13 psia has been measured in the annular space between frustums 16 and 17, i.e., a vacuum of the order of 40 inches of water column. With smaller source pressure, smaller but significant vacuums have also been measured—for example, a vacuum of the order of 30 inches of water column with a source pressure of 8 psig, a vacuum of the order of 18 inches of water column with a source pressure of 4 psig, and a vacuum of the order of 10 inches of water column with a source pressure of 2 psig. The pressure drop between the ambient pressure and the subatmospheric pressure in the annular region between frustums 16 and 17 produces an annular shock wave that enhances the energization of the vortically flowing gas.

Preferably, the distance between the bases of frustums 16 and 17 is approximately equal to a multiple of one-half the diameter of bases 16 and 17; e.g., the muliple is two. Frustums 16 and 17 are as close to outlet 11 as possible without cutting off the flow of gas through passage 10, e.g., of the order of 0.010 to 0.020 inch. The thickness of each of frustums 16 and 17, i.e., the dimension perpendicular to the surface of their bases, is less than one-half of the diameter of their bases. In this case, the multiple is two. Thus, as shown in FIG. 1, the apexes of frustums 16 and 17 are spaced apart a short distance.

In a typical embodiment in which passage 10, outlet 11, inlet 12, frustum 18, and nozzle 19 have the same dimensions and positions as the typical embodiment described in connection with FIG. 1 of my referenced application, the space between outlet 11 and the base of frustum 16 is 0.020 inch, the diameter of frustums 16 and 17 is 0.200 inch, the conical half-angle of frustum 16 and 17 is 34.6°, the distance between the bases of frustums 16 and 17 is 0.200 inch, and the thickness of frustums 16 and 17 is 0.069 inch.

The vacuum in the annular space between frustums 16 and 17 can be increased, approximately doubled, by surrounding frustums 16 and 17 with a sheath. In a typical embodiment where frustums 16 and 17 have a base diameter of 0.200 inch, the sheath is a cylindrical pipe having an internal diameter of 0.380 inch, open at both ends, and abutting the end surface of outlet 11 and extending therefrom along axis 13 to a point beyond frustums 16 and 17.

Figure 2:
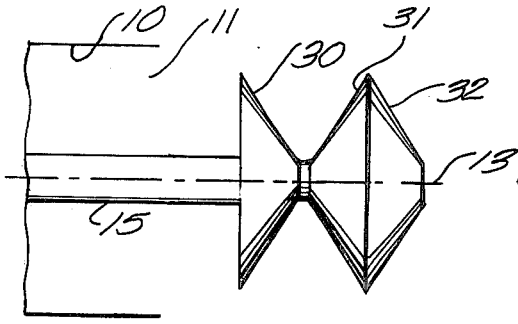
FIG. 2 is a schematic diagram of a variation of the bluff body of FIG. 1.
Figure 3:
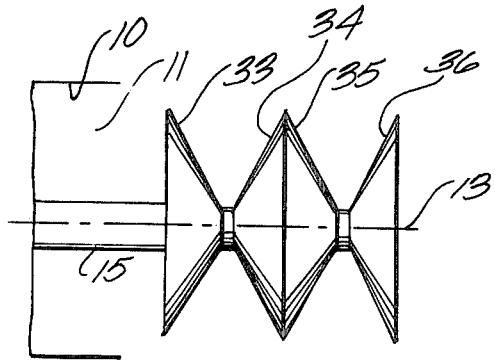
FIG. 3 is a schematic diagram of another variation of the bluff body of FIG. 1.

FIGS. 2 though 6 disclose other embodiments of a bluff body external to the vortex generating device of FIG. 1. In FIG. 2, the bluff body comprises frustums 30, 31, and 32. As frustums 16 and 17 in FIG. 1, frustums 30 and 31 are arranged apex-to-apex to form therebetween an annular channel, the base of frustum 30 facing toward outlet 11, and the base of frustum 31 facing away from outlet 11. Frustums 31 and 32 are arranged base-to-base, the base of frustum 32 abutting the base of frustum 31. In this embodiment, frustum 32 serves to stabilize the gas flow under some circumstances. Preferably, frustums 30, 31, and 32 are all identical in size and aligned with axis 13. In FIG. 3, the bluff body comprises frustums 33, 34, 35, and 36. As frustums 16 and 17 in FIG. 1, frustums 33 and 34 are arranged apex-to-apex to form therebetween an annular channel, the base of frustum 33 facing toward outlet 11, and the base of frustum 34 facing away from outlet 11. Similarly, frustums 35 and 36 are also arranged apex-to-apex to form therebetween an annular channel, and frustum 35 is arranged base-to-base with frustum 34. The distance between frustums 33 and 34 and the distance between frustums 35 and 36 are each preferably approximately equal to a multiple of one-half of their diameter. The two pairs of frustums further increase the energization of the gas intercepted by the bluff body.

Figure 4:
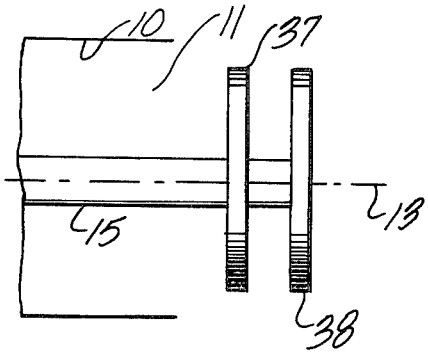
FIG. 4 is a schematic diagram of a substitute of the bluff body of FIG. 1.

The bluff body in FIG. 4 comprises, as substitutes for frustums 16 and 17 in FIG. 1, flat circular discus 37 and 38 arranged side by side in alignment with axis 13 external to passage 10 to form therebetween an annular channel. A subatmospheric pressure is produced in the annular space between discs 37 and 38 in a fashion similar to the embodiment of FIG. 1. The spacing between discs 37 and 38 is approximately equal to a multiple of one-half of their diameter. Generally, the multiple is one or two, i.e., the distance between discs 37 and 38 is one-half the diameter or one full diameter. The thickness of discs 37 and 38 is less than one-half their diameter. In a typical embodiment, the distance from outlet 11 to disc 37 is 0.020 inch, the distance from the downstream surface of disc 37 to the upstream surface of disc 38 is 0.200 inch, the diameter of discs 37 and 38 is 0.200 inch, and the thickness of each of discs 37 and 38 is 0.032 inch.

Figure 5:
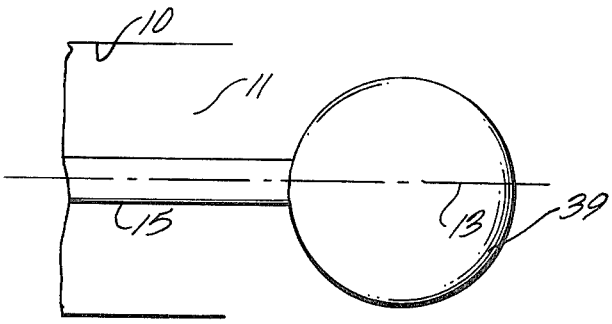
FIG. 5 is a schematic diagram of another embodiment of an external bluff body.

In FIG. 5, the bluff body comprises a sphere 39 which produces a standing shock serving as a reflector of the gas emanating from outlet 11. In a typical embodiment in which the dimensions of the vortex generating device are the same as those of the typical embodiment in FIG. 1 of the referenced application, sphere 39 has a diameter of 0.1875 inch and the distance from outlet 11 to sphere 39 is 0.100 inch.

Figure 6:
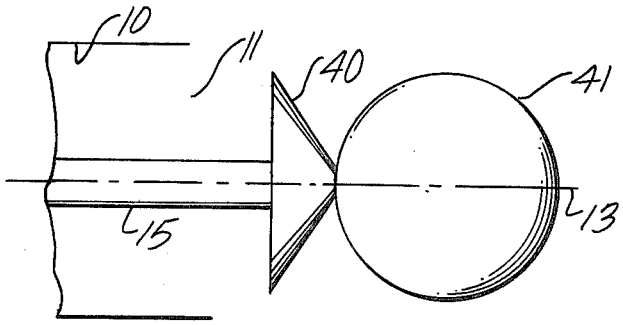
FIG. 6 is a schematic diagram of another embodiment of an external bluff body.

In FIG. 6, the bluff body comprises a frustum 40 and a sphere 41 arranged in abutting relationship to form therebetween an annular channel. Frustum 40 is closer to inlet 12 than sphere 41. Its base faces toward inlet 12, and its apex abuts sphere 41. In a typical embodiment, the distance from outlet 11 to the base of frustum 40 is 0.020 inch, the base diameter of frustum 40 is 0.200 inch, the thickness of frustum 40 is 0.069 inch, the conical half-angle of frustum 40 is 34.6°, and the diameter of sphere 41 is 0.1875 inch.

Figure 7:
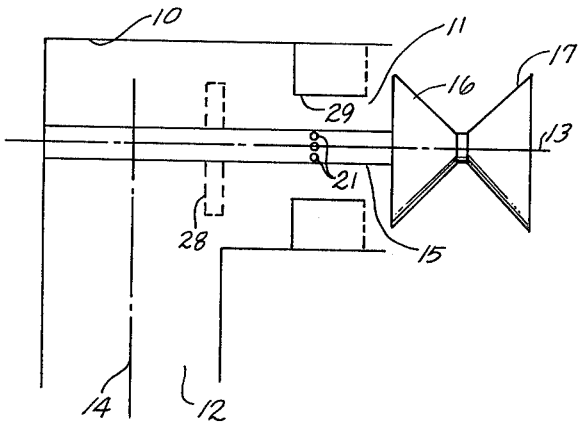
FIG. 7 is a schematic diagram of an alternative vortex generating device with an external bluff body incorporating the principles of the invention.

In FIG. 7, a thin flat circular disc 28 is substituted for frustum 18, and a thin flat ring 29 is substituted for nozzle 19. The thickness of disc 28 is not a significant factor, but is preferably less than one-half its diameter. The thickness of ring 29 for supersonic flow should be at least one-half the diameter of disc 28. For most efficient operation, the distance between disc 28 and the upstream side of ring 29 is preferably approximately equal to the diameter of disc 28 or one-half the diameter of disc 28.

To date, the parts of the device have been machined from metal such as steel. However, it is believed that the invention will function to the same extent with molded plastic parts.

The cross-sectional area of rod 15 is preferably between about 10% to 20% of the minimum cross-sectional area of the restriction, i.e., the cross-sectional area of nozzle 19 or ring 29. It has been found that when the cross-sectional area of rod 15 is much less than 10% or exceeds 50% of the minimum cross-sectional area of the restriction (i.e., the area of the restriction in the absence of the rod), operation of the device becomes impaired; therefore, these limits should not be exceeded.

For most efficient operation of the device of FIG. 1 or the device of FIG. 7, it is preferable to follow several rules of design. The first rule is that the cross-sectional area of the annulus between frustum 18 (or disc 28) and the surface of passage 10 be at least 10% larger, and preferably 20% larger, than the minimum cross-sectional area of the restriction, i.e., the cross-sectional area of nozzle 19 (or ring 29). The second rule is that the annular space between the surface of passage 10 and frustum 18 (or disc 28) be as small as possible consistent with the first rule; the ratio of this space to the base diameter of frustum 18 should never exceed 30%, or, in other words, the ratio of the base diameter of frustum 18 to the diameter of the passage 10 should be at least 0.625. The third rule is that the circumference of frustum 18 (or disc 28) be as large as possible consistent with the first and second rules.

The described embodiments, of the invention are only considered to be preferred and illustrative of the inventive concept; the scope of the invention is not to be restricted to such embodiments. Various and numerous other arrangements may be devised by one skilled in the art without departing from the spirit and scope of this invention. For example, any number of frustums or discs could be mounted on the rod in the manner illustrated in FIGS. 1, 3, and 4. Further, any type of vortex generating device could be employed with the external bluff bodies of the invention, although those in my referenced application are preferred. Similarly, although the particular bluff body embodiments disclosed herein have been found to be preferred, the bluff body may take any shape or form that produces a standing shock wave to function as a reflector of the sonic waves in the fluid emanating from the outlet of the passage.

What is claimed is:

1. A vortex generating device comprising:

a flow passage having a fluid inlet and a fluid outlet;

means for forming a vortex in fluid flowing through the passage from inlet to outlet;

a first bluff body disposed at the outlet external to the passage; and a second bluff body disposed at the outlet external to the passage between the outlet and the first bluff body to form between the bluff bodies an annular channel, the second bluff body having a flat surface facing the outlet.

2. The device of claim 1, in which the second bluff body comprises a frustum having a base facing the outlet.

3. The device of claim 1, in which the bluff bodies comprise first and second frustums arranged apex-to-apex, the first frustum having a base facing toward the outlet and the second frustum having a base facing away from the outlet.

4. The device of claim 3, in which the spacing between the bases of the frustums is approximately equal to the diameter of the frustums.

5. The device of claim 4, in which the thickness of the frustums is less than one-half their diameter.

6. The device of claim 3, additionally comprising a third frustum arranged base-to-base with the second frustum.

7. The device of claim 3, additionally comprising third and fourth frustums arranged apex-to-apex, and the second and third frustums being arranged base-to-base.

8. The device of claim 1, in which the bluff bodies comprise first and second flat circular discs arranged in spaced side-by-side relationship.

9. The device of claim 8, in which the spacing between the discs is approximately equal to the diameter or one-half the diameter of the discs.

10. The device of claim 9, in which the thickness of the discs is less than one-half their diameter.

11. The device of claim 1, in which the first bluff body comprises a sphere.

12. The device of claim 1, in which the second bluff body comprises a frustum and the first bluff body comprises a sphere, the base of the frustum facing toward the outlet and the apex of the frustum abutting the sphere.

13. The device of claim 1, additionally comprising a rod extending along the full length of the flow passage to an end external to the passage, the bluff bodies being supported by the end of the rod.

14. The vortex generating device of claim 1, in which the vortex forming means comprising:

a restriction in the flow passage; and an internal bluff body disposed in the flow passage upstream of the restriction, the bluff body having a flat surface facing upstream to interrupt fluid flow.

15. The device of claim 14, in which the internal bluff body is a frustum having a base facing upstream and an apex facing downstream.

16. The device of claim 15, in which the inlet is positioned such that the base and a portion only of the frustum are exposed to the inlet.

17. The device of claim 16, in which the flow passage has a given cross-sectional area and the restriction comprises a cylindrical section having a cross-sectional area smaller than the given cross-sectional area, and a diverging section joining the cylindrical section to the outlet.

18. The device of claim 17, additionally comprising a rod aligned with the flow passage, the frustum being mounted on the rod.

19. The device of claim 18, in which the rod is hollow and has one or more holes near the restriction, the device additionally comprising a source of liquid to be atomized connected to the rod to feed the liquid to the restriction.

20. The device of claim 14, in which the flow passage, the internal bluff body, the restriction, and the outlet are aligned with a common flow axis, and the inlet is aligned with an axis transverse to the common flow axis.

21. The device of claim 20, in which the internal bluff body comprises a frustum having a base facing upstream and an apex facing downstream.

22. The device of claim 20, in which the internal bluff body comprises a circular disc.

23. The device of claim 14, in which the internal bluff body comprises a circular disc.

24. The device of claim 23, in which the circular disc has a cylindrical edge.

25. The device of claim 23, in which the flow passage has a given cross-sectional area and the restriction comprises a thin flat ring having a circular opening with a cross-sectional area smaller than the given cross-sectional area.

26. The device of claim 25, additionally comprising a rod aligned with the common flow axis in the flow passage, the disc being mounted on the rod.

27. The device of claim 26, in which the rod is hollow and has one or more holes near the restriction, the device additionally comprising a source of liquid to be atomized.

28. The device of claim 25, in which the distance between the disc and the ring is the diameter of the disc or one-half the diameter of the disc.

29. The device of claim 28, in which the thickness of the ring is at least one-half the diameter of the disc.

30. The device of claim 14, additionally comprising a rod extending along the flow passage, the bluff body being mounted on the rod.

31. The device of claim 30, in which the rod is hollow and has one or more holes near the restriction, the device additionally comprising a source of liquid to be atomized connected to the rod to feed the liquid to the restriction.

32. The device of claim 30, in which the cross-sectional area of the rod is less than 50% of the minimum cross-sectional area of the restriction.

33. The device of claim 32, in which the cross-sectional area of the rod is about 20% of the minimum cross-sectional area of the restriction.

34. The device of claim 14, in which the flow passage has a given cross-sectional area and the restriction comprises a cylindrical section having a cross-sectional area smaller than the given cross-sectional area, and a diverging section joining the cylindrical section to the outlet.

35. The device of claim 14, in which the flow passage has a given cross-sectional area and the restriction comprises a thin, flat ring having a circular hole with a cross-sectional area smaller than the given cross-sectional area.

36. The device of claim 14, in which the space between the internal bluff body and the surface of the flow passage is less than 30% of the distance across the flat surface of the body.

37. The device of claim 14, in which the cross-sectional area of the space between the surface of the flow passage and the internal bluff body is at least 10% larger than the minimum cross-sectional area of the restriction.

38. The device of claim 37, in which the cross-sectional area of the space between the internal bluff body and the surface of the flow passage is about 20% larger than the minimum cross-sectional area of the restriction.

39. The device of claim 14, additionally comprising a source of gas connected to the fluid inlet, the pressure difference between the source and the fluid outlet being such that gas from the source flowing through the flow passage from inlet to outlet forms vortices as it passes over the internal bluff body.

40. The vortex generating device of claim 1, in which the vortex generating means comprises:

a rod in the flow passage, the rod extending across the inlet so fluid through the inlet is interrupted by the rod; and an internal bluff body mounted on the rod in the flow passage at or near the inlet.

41. The device of claim 40, in which the internal bluff body comprises a frustum having a base facing upstream and an apex facing downstream.

42. The device of claim 40, in which the internal bluff body comprises a circular disc.

43. The device of claim 42, in which the disc has a cylindrical edge.

44. The device of claim 42, in which the thickness of the disc is less than one-half the diameter of the disc.

45. The device of claim 44, in which the inlet is aligned with an axis transverse to the flow axis.

46. The device of claim 40, in which the space between the internal bluff body and the surface of the flow passage is less than 30% of the distance across the internal bluff body transverse to the flow axis.

47. The device of claim 40, additionally comprising a restriction in the flow passage downstream of the internal bluff body.

48. The device of claim 47, in which the cross-sectional area of the rod is less than 50% of the minimum cross-sectional area of the restriction.

49. The device of claim 48, in which the cross-sectional area of the rod is about 20% of the minimum cross-sectional area of the restriction.

50. The device of claim 47, in which the cross-sectional area between the internal bluff body and the surface of the flow passage is at least 10% larger than the minimum cross-sectional area of the restriction.

51. The device of claim 50, in which the cross-sectional area between the internal bluff body and the surface of the flow passage is about 20% larger than the minimum cross-sectional area of the restriction.

52. The device of claim 50, in which the flow passage has a given cross-sectional area and the restriction comprises a thin, flat ring having a circular opening with a cross-sectional area smaller than the given cross-sectional area.

53. The device of claim 47, in which the rod is hollow and has one or more holes near the restriction, the device additionally comprising a source of liquid to be atomized connected to the rod to feed the liquid to the restriction.

54. The vortex generating device of claim 1, in which the vortex generating means comprises:

a source of gas under pressure larger than the ambient pressure into which the outlet opens connected to the inlet to cause the gas to pass through the flow passage; and means for generating a plurality of tornado-like vortices in the gas arranged in a ring about the flow axis, the vortices rotating about the flow axis.

55. The device of claim 54, additionally comprising means for combining the plurality of vortices into a single vortex rotating about the flow axis.

56. The device of claim 55, in which the means for generating a plurality of vortices comprises an internal bluff body aligned with the flow axis at or near the inlet.

57. The device of claim 56, in which the means for combining the plurality of vortices comprises a restriction formed in the flow passage between the internal bluff body and the outlet.

58. The device of claim 1, in which the flow passage and the fluid outlet are both aligned with a common flow axis and the fluid inlet is aligned with an inlet axis lying in the same plane as the flow axis.

59. The device of claim 58, in which the inlet axis is transverse to the common flow axis.

60. The device of claim 58, additionally comprising a restriction in the flow passage aligned with the flow axis.

61. The device of claim 1, additionally comprising a source of liquid to be atomized and means for supplying liquid from the source to a point along the flow passage for atomization.

62. A vortex generating device comprising:

a flow passage aligned with a flow axis;

an outlet from the passage aligned with the flow axis;

an inlet to the passage aligned with an inlet axis lying in the same plane as the flow axis;

a source of gas connected to the inlet to cause gas to flow through the passage to the outlet; and means for forming a vortex in the gas flowing through the passage including a first bluff body disposed at the outlet;

a second bluff body disposed at the outlet upstream of the first bluff body to form between the bluff bodies an annular channel, the second bluff body having a flat surface facing upstream; and a restriction in the passage aligned with the flow axis upstream of the bluff bodies.

63. The device of claim 62, additionally comprising a source of liquid to be atomized and means for supplying liquid from the source to a point along the flow passage for atomization.

* * * * *